US007256679B2

(12) United States Patent
Arai et al.

(10) Patent No.: US 7,256,679 B2
(45) Date of Patent: Aug. 14, 2007

(54) STICK LEVER UNITS

(75) Inventors: Masahiro Arai, Chiba (JP); Masashi Tokita, Chiba (JP); Takahiro Isono, Chiba (JP)

(73) Assignee: Futaba Corporation, Mobara-shi, Chiba-ken (JP)

( * ) Notice: Subject to any disclaimer, the term of this patent is extended or adjusted under 35 U.S.C. 154(b) by 91 days.

(21) Appl. No.: 11/231,247

(22) Filed: Sep. 20, 2005

(65) Prior Publication Data

US 2006/0066437 A1 Mar. 30, 2006

(30) Foreign Application Priority Data

Sep. 30, 2004 (JP) ..... 2004-287931
Sep. 30, 2004 (JP) ..... 2004-287932

(51) Int. Cl.
*H01C 10/16* (2006.01)

(52) U.S. Cl. ..... 338/128; 338/131; 345/161; 345/167; 341/22

(58) Field of Classification Search ..... 338/128–134, 338/195; 345/161, 156, 167–168; 200/6 A, 200/5 R; 341/22–35
See application file for complete search history.

(56) References Cited

U.S. PATENT DOCUMENTS 4,245,137 A * 1/1981 Hirai et al. ..... 200/4
5,068,499 A * 11/1991 Kuratani ..... 200/6 A
5,229,742 A * 7/1993 Miyamoto et al. ..... 338/128
6,310,606 B1 * 10/2001 Armstrong ..... 345/161
6,504,115 B2 * 1/2003 Nakai ..... 200/6 A
6,617,957 B2 * 9/2003 Ishikawa ..... 338/128

FOREIGN PATENT DOCUMENTS

JP 57-169393 10/1982
JP 62-87697 6/1987

* cited by examiner

*Primary Examiner*—Richard K. Lee
(74) *Attorney, Agent, or Firm*—Quarles & Brady LLP

(57) ABSTRACT

A stick lever unit is provided that is capable of eliminating uncomfortable feeling during manipulation of the stick, as well as, minimizing breaking of a wiring conductor of the variable resistor. The stick lever unit includes a fixing member, a first variable resistor attached to the fixing member, a first rotational member rotatably journalled to the fixing member for rotationally controlling the first variable resistor, a second variable resistor attached to the first rotational member, and a second rotational member having a stick lever and being rotationally journalled to the first rotational member to rotationally control the second variable resistor. The wiring conductors of the second variable resistor are derived out from the lead-out hole in the rotational shaft of the first rotational member, which is attached to the second variable resistor.

10 Claims, 6 Drawing Sheets

SECTION A-A

SECTION B-B

SECTION C-C

SECTION D-D

STICK LEVER UNITS

CROSS REFERENCES TO RELATED APPLICATIONS

This application claims the priority benefit of Japanese Patent Application No. 2004-287931 filed on Sep. 30, 2004 and Japanese Patent Application No. 2004-287932 filed on Sep. 30, 2004.

STATEMENT REGARDING FEDERALLY SPONSORED RESEARCH

Not Applicable.

BACKGROUND OF THE INVENTION

The present invention relates to stick lever units, which are capable of creating control signals for maneuvering of models, control of industrial machines, manipulation of game consoles, and the like.

Generally, stick lever units for creating control signals are attached to radio controlled transmitters for maneuvering models, respectively. The basic structure of a conventional stick lever unit will be explained below by referring to the schematic diagram of FIG. 12. A first variable resistor 101 is attached to the outer side of a frame fixing member 100, which is attached on the housing of a radio-controlled transmitter. A first rotational member 104 having a frame shape is rotatably journalled inside of the fixing member 100 by means of the shaft 102 of the first variable resistor 101 and by means of one rotational shaft 103 coaxial to the shaft 102. A second variable resistor 105 is attached outside the first rotational member 104. A second rotational member 107 with a stick 106 is rotationally journalled inside the first rotational member 104 through the shaft 108 of the second variable resistor 105. Wiring conductors 109 of the first variable resistor 101 are connected to the control substrate (not shown). Wiring conductors 110 of the second variable resistor 105 are externally derived beyond the frame wall of the fixing member 100 and are connected to the control substrate.

The rotational shaft 103 of the first rotational member 104 (or the shaft 102 of the first variable resistor 101) is perpendicular to the rotational shaft of the second rotational member 107 (or the shaft 108 of the second variable resistor 105). Accordingly, when an operator manipulates the stick lever 106 attached to the second rotational member 107 in given directions with his fingers, the two variable resistors 101 and 105 are controlled suitably and rotatably, so that control signals of two kinds are created.

A radio-controlled transmitter for a model airplane, for example, respectively manipulates the rudder and the elevator, each which controls the attitude of the model airplane, by means of two servomotors mounted on the fuselage. With one stick lever unit mounted on the radio-controlled transmitter, allocated for control of the rudder and the elevator, control signals for two servomotors respectively driving the rudder and the elevator are obtained by controlling one stick to control the attitude of the airplane. Japanese Utility Model Laid-open Publication No. 57-169393 and Japanese Utility Model Laid-open Publication No. 62-87697 disclose a further specific structure of the above stick lever unit.

In the conventional stick lever unit, the first rotational member 104 is attached to the second variable resistor 105 by rotating the stick 106. As a result, the whole of the wiring conductors 110 derived out from the second variable resistor 105 through the fixing member 100 moves largely. This works as a resistance when the stick 106 is operated which causes an uncomfortable feeling to the operator.

Since the wiring conductors 110 from the second variable resistor 105 always moves together with the first rotational member 104, the wiring conductors 110 undergo repeatedly deformation such as expansion, contraction, twisting, and the like. This repeated deformation over a long period of time may cause the wiring conductors 110 to break.

SUMMARY OF THE INVENTION

The present invention aims at solving the problem of the resistance on operation of the stick (or uncomfortable operational feeling) due to the whole of the wiring conductors 110 of the second variable resistor 105 always moving together with the rotation of the first rotational member 104 and the problem of breakage of a wiring conductor. Accordingly, an object of the present invention is to provide an improved stick lever unit.

In an aspect of the present invention, a stick lever unit comprises a fixing member; a first variable resistor attached to the fixing member; a first rotational member rotatably journalled to the fixing member for rotationally controlling the first variable resistor; a second variable resistor attached to the first rotational member; and a second rotational member having a stick lever, the second rotational member being rotationally journalled to the first rotational member to rotationally control the second variable resistor. The first rotational member has a first rotational shaft journalled on the fixing member and a second rotational shaft linked to a rotational operation section of the first variable resistor. At least one of the first and second rotational shafts has a lead-out hole for deriving electrical wiring conductors connected to the second variable resistor externally from the fixing member.

In another aspect of the present invention, a stick lever unit comprises a fixing member; a first variable resistor attached to the fixing member; a first rotational member rotatably journalled to the fixing member for rotationally controlling the first variable resistor; a second variable resistor attached to the first rotational member; and a second rotational member having a stick lever, the second rotational member being rotationally journalled to the first rotational member to rotationally control the second variable resistor. The first rotational member has a rotational shaft which is journalled on a rotational operation section of the first variable resistor. The rotational shaft has a lead-out hole for deriving electrical wiring conductors connected to the second variable resistor externally from the fixing member.

In the stick lever unit according to the present invention, the first variable resistor comprises a rotational body having a through hole, as a rotational operation section for varying a resistance value. The rotational shaft of the first rotational member is inserted into the through hole of the first variable resistor and is linked to the rotational body. The lead-out hole of the rotational shaft is communicated with the inner side and the outer side of the fixing member.

In the stick lever unit according to the present invention, the fixing member has an opening at its side surface. The first variable resistor is attached to an outer surface of the fixing member in such a way that the through hole communicates with the opening. The rotational shaft of the first rotational member is inserted into the through hole in the first variable resistor, thus being linked to the rotational body.

In the stick lever unit according to the present invention, The lead-out hole opens at an end of the rotational shaft and opens in the inside of the fixing member through a guide hole continuously formed in a direction perpendicular to the lead-out hole.

In the stick lever unit according to the present invention, the aperture diameter of the guide hole decreases gradually toward the lead-out hole.

In the stick lever unit according to the present invention, the electrical wiring conductors from the second variable resistor can be derived out from the fixing member through the lead-out hole formed in one rotational shaft of the first rotational member journalled on the fixing member or through the lead-out hole formed on the other rotational shaft of the first rotational member linked to the first variable resistor. Hence, even when the first rotational member rotates by means of the stick operation, the movement of the electrical wiring conductors is small. This provides small resistance on manipulation and small uncomfortable feeling to the stick operator. Moreover, it becomes hard to damage and line break the electrical conductors. Deriving the wiring conductors from the fixing member can be realized through selecting at least one (or both, if necessary) of two rotational shafts of the first rotational member. This feature provides facilities for electrical connection to external devices. There is a lot of flexibility in device design.

In the stick lever unit according to the present invention, the electrical wiring conductors of the second variable resistor are derived out from the fixing member through the guide hole formed in the rotational shaft of the first rotational member to which the second variable resistor is attached. Hence, even when the first rotational member rotates by the stick operation, the movement of the electrical wiring conductors is small. This provides a small sense of resistance and minimizes any uncomfortable feeling on operation to the stick operator. Moreover, it reduces the likelihood that the electrical conductors are damaged and line-broken.

According to the stick lever unit according to the present invention, in the first variable resistor, the rotational operation section varying the resistance value has a rotational body having a through hole. The rotational body rotates to the fixing member by means of only the rotational shaft mounted on the first rotational member. The electrical conductors of the second variable resistor are derived from the fixing member through the guide hole formed on the rotational shaft of the first rotational member and through the through hole in the first variable resistor. This feature improves the stick operability to rotate the first rotational member. Thus, the effect of the stick lever unit according to the present invention can be obtained certainly.

According to the stick lever unit according to the present invention, the structure fabricable in a simple procedure can realize the effect of the stick lever unit. That is, the stick lever unit can be fabricated in the steps of first mounting the first rotational member to the fixing member via the rotational shaft, then inserting the rotational body of the first rotational member into the end of one rotational shaft protruded outward from the fixing member, and fixing the first variable resistor to the outer surface of the fixing member.

In the stick lever unit according to the present invention, when the electrical conductors of the second variable resistor are derived out from the fixing member, the electrical conductors are inserted and driven inward from the lead-out hole opening at the end of the rotational shaft of the first rotational member. Thus, the electrical conductors come out into the fixing member through the guide hole. Accordingly, the electrical conductors can be connected to the terminals of the second variable resistor.

In the stick lever unit according to the present invention, the aperture diameter of the guide hole decreases gradually toward the lead-out hole and the diameter of the guide hole, acting as the exit for the electrical wiring conductors, increases in the exit direction. Hence, when the electrical conductors are inserted into the fixing member from the guide hole through the lead-out hole opening at the end of the rotational shaft of the first rotational member, the insertion work is easily performed.

BRIEF DESCRIPTION OF THE DRAWINGS

This and other objects, features, and advantages of the present invention will become more apparent upon reading of the following detailed description and drawings, in which.

DESCRIPTION OF THE EMBODIMENTS

Figure 1:
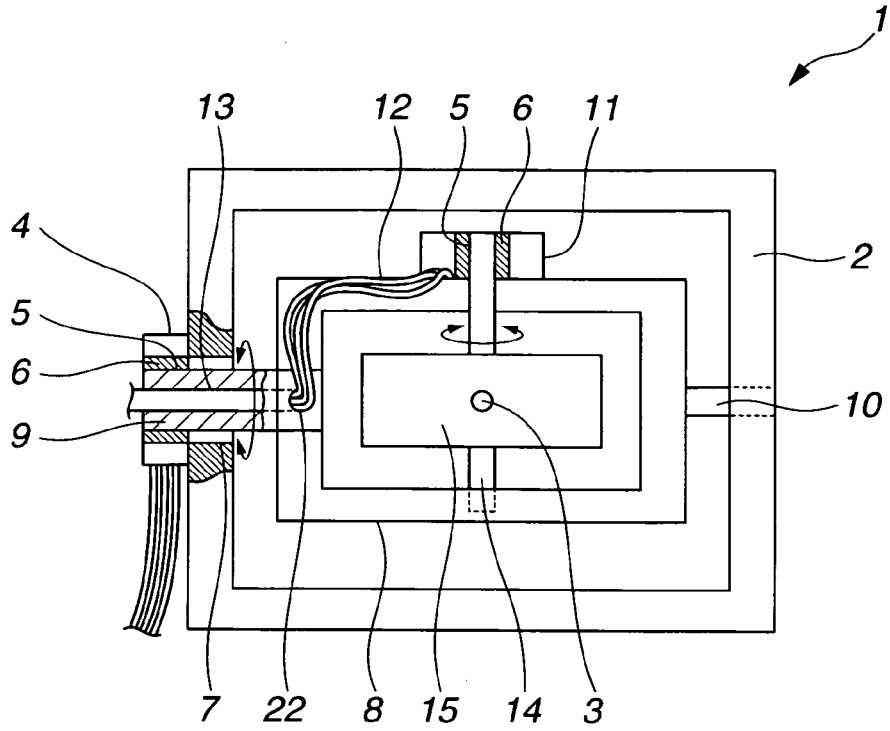
FIG. 1 is a schematic structural view explaining the basic structure of a stick lever unit according to an embodiment of the present invention.

The best mode for embodying the present invention will be described below by referring to FIGS. 1 to 12. The basic structure of a stick lever unit according to the present invention will be explained below by referring to FIG. 1.

The stick lever unit 1 of the present embodiment includes as a main body a fixing member 2 fixed to the housing of a radio-controlled transmitter. The fixing member 2 is a frame member, in a nearly rectangular shape, having a space in which the rotational mechanism of the stick 3 is assembled. A first variable resistor 4 is mounted on the outer side of the side wall of the fixing member 2. The first variable resistor 4 is a rotational-type variable resistor that includes a rotational body 6 with a through hole 5, as a rotational operation section varying the resistance value. When the shaft, which is connected to the rotational body 6 through the through hole 5, is rotated, the resistance value changes. The opening 7 is formed in one side wall of the fixing member 2. The first variable resistor 4 is mounted on the outer side of the fixing member 2 so as to communicate the through hole 5 with the opening 7.

A first rotational member 8, which controllably rotates the first variable resistor 4, is disposed in the inner space of the fixing member 2 and is journalled so as to rotate freely relative to the fixing member 2. The first rotational member 8 is a frame member in a nearly rectangular shape as a whole, having a space in which the rotational mechanism of the stick 3 is assembled. A pair of rotational shafts 9 and 10 protrude through a pair of confronting side walls aligned with the axis line. One rotational shaft 10 of the first rotational member 8 is rotatably connected to one side wall of the fixing member 2. The other rotational shaft 9 is inserted into the through hole 5 of the first variable resistor 4 through the opening 7 of the fixing member 2. Thus, the rotational shaft 9 is linked to the rotational body 6. Accordingly, the first rotational member 8 rotates with respect to the fixing member 2, the rotational body 6 of the first variable resistor 4 rotates, so that the resistance value changes.

In the embodiment, the pair of rotational shafts 9 and 10 of the first rotational member 8 are shaped integrally with the main body and the axis line is aligned with high accuracy. Hence, the first rotational member 8 rotates smoothly relative to the fixing member 2. Good feeling is provided during operation of the stick. First, the first rotational member 8 is rotatably attached to the fixing member 2. Thereafter, the rotational body 6 of the first rotational resistor 4 is inserted into the end of one rotational shaft 9 protruding out from the fixing member 2. The first variable resistor 4 is fixed to the outer surface of the fixing member 2. Since the stick lever unit can be assembled in such an order, the first variable resistor 4 and the rotational shafts 9 and 10 can be assembled without difficulty. During operation of the stick, the first rotational member 8 can be smoothly rotated, without placing a burden on the first variable resistor 4. The present embodiment can prolong the operational life of the first variable resistor 4, compared with the conventional stick lever unit, which utilizes the shaft of the shaft-type variable resistor 4 as one rotational shaft of the rotational member.

The lead-out hole 13 is formed at the center of the other rotational shaft 9 of the first rotational member 8 to lead the wiring conductors 12 of the second variable resistor 11 (to be described later). One end thereof opens in the end surface of the rotational shaft 9 and the other end is deflected upward 90 degrees and opens on the upper surface of the side wall of the first rotational member 8 via the guide hole 22. In other words, the inner side and the outer side of the fixing member 2 communicate via the lead-out hole 13 of the rotational shaft 9.

A second variable resistor 11 is attached on one outer surface of the pair of walls of the first rotational member 8 parallel to the rotational shafts 9 and 10. The second variable resistor 11 is a rotational-type variable resistor having a rotational body 6 with a through hole 5, acting as a resistance value varying rotational operation section. The second variable resistor 11 has the same structure as the first variable resistor 4. The shaft 14 has one end linked to the rotational body 6 via the through hole 5 and the other end journalled rotatably on the wall of the first rotational member 8. The shaft 14 can be rotated to change the resistance value of the second variable resistor 11. The second rotational member 15 is fixed to the shaft 14 in the inner space of the first rotational member 8. Accordingly, when the second rotational member 15 rotates with respect to the first rotational member 8, the shaft 14 of the second variable resistor 11 rotates, so that the resistance value varies.

A stick lever 3 is attached to the second rotational member 15. An operator manipulates the stick 3 with his fingers. The first rotational member 8 and the second rotational member 15 rotate in desired direction, if necessary. Thus, the first variable resistor 4 and the second variable resistor 11 can vary their resistance values, respectively.

In this embodiment, the second variable resistor 11 is of the type of which the resistance is varied by rotating the rotational body 6 with the through hole 5, like the first variable resistor 4. However, a shaft-type variable resistor with a shaft protruding out from the main body may be used as a rotational operation section varying the resistance value. In this case, the shaft of the second variable resistor is bridged to be rotatably between a pair of walls of the first rotational member 8, parallel to the rotational shafts 9 and 10. The second rotational member 15 is fixed to the shaft in the inner space of the first rotational member 8. Hence, when the second rotational member rotates with respect to the first rotational member, the shaft of the shaft-type second variable resistor rotates, so that the resistance value varies.

Mechanisms (not shown in FIG. 1) for restoring toward the neutral position are mounted to the first rotational member 8 and the second rotational member 15, respectively. That is, the first rotational member 8 and the second rotational member 15 can rotate in desired directions, respectively, each around a desired axis line acting as center. However, the first rotational member 8 and the second rotational member 15 are set to the neutral position in a way that the first variable resistor 4 and the second variable resistor 11 have a predetermined middle resistance value, respectively. When an external force is not applied to the stick 3, the biasing means sets the first rotational member 8 and the second rotational member 15 to the neutral position.

In the present embodiment, each of the first variable resistor 4 and the second variable resistor 11 has three electrical wiring conductors (hereinafter, merely referred to as wiring conductors) for a plus signal, a minus signal, and a middle tap signal. The first variable resistor 4 is fixed to the fixing member 2, but the second variable resistor 11 rotates together with the first rotational member 8. Accordingly, if the structure is employed where the wiring conductors of the second variable resistor 11 are derived out from the fixing member 2 and are connected to the substrate (not shown), the wiring conductors of the second variable resistor 11 move upon rotation of the first rotational member 8 without a change in the resistance of the second variable resistor 11. The movement of the wiring conductors affects the feeling of operating the stick 3.

However, in the present embodiment, the wiring conductors 12 of the second variable resistor 11 are led out from the guide hole 22 in the first rotational member 8 through the lead-out hole 13 and are derived outside the fixing member 2 from the shaft end of the rotational shaft 9. In other words, because the wiring conductors 12 of the second variable resistor 11 are held in the lead-out hole 13 formed along the center of the rotational member 9 of the first rotational member 8, the whole of the wiring conductors 12 does not move together with the rotation of the first rotational member 8. For that reason, the existence of the wiring conductors 12 does not cause a resistance against the rotation of the first rotational member 8 and thus does not affect the feeling of operation of the stick 3. Because the wiring conductors 12 of the second variable resistor 11 do not move largely, there is no fear of breaking the wiring conductors 12 due to repetitive operations.

In the present embodiment, the wiring conductors 12 of the second variable resistor 11 are led out from the fixing member 2 through the lead-out hole 13, which is formed in the rotational shaft 9 of the first rotational member 8.

However, the wiring conductors 12 of the second variable resistor 11 may be derived out from the fixing member 2 via the lead-out hole formed in the rotational shaft 10. The lead-out path of the wiring conductors 12 derived out from the fixing member 2 can be arbitrarily selected according to the convenience of electrical connection to external devices and the necessity in device designing.

A specific structural example of the stick lever unit 1' in the present invention will be explained by referring to FIGS. 2 to 11. Like numerals are affixed to constituent elements common in function to elements in FIG. 1. For explanation, the figure is referred to, if necessary.

Figure 2:
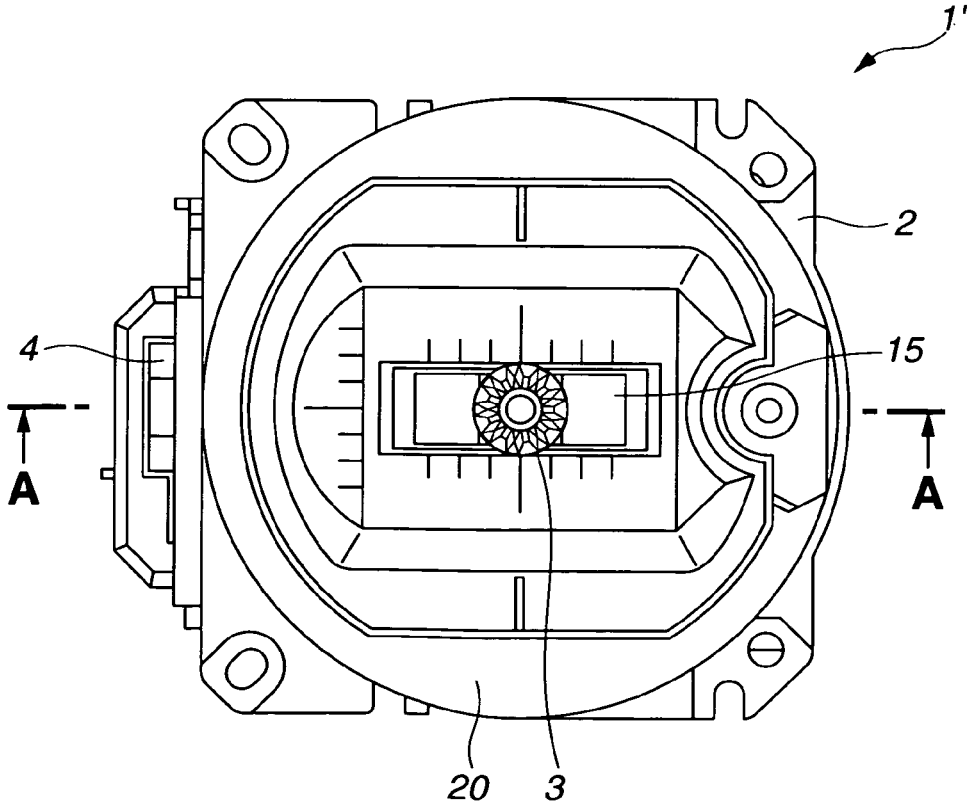
FIG. 2 is a plan view illustrating the stick lever unit having the basic structure of the present invention.
Figure 3:
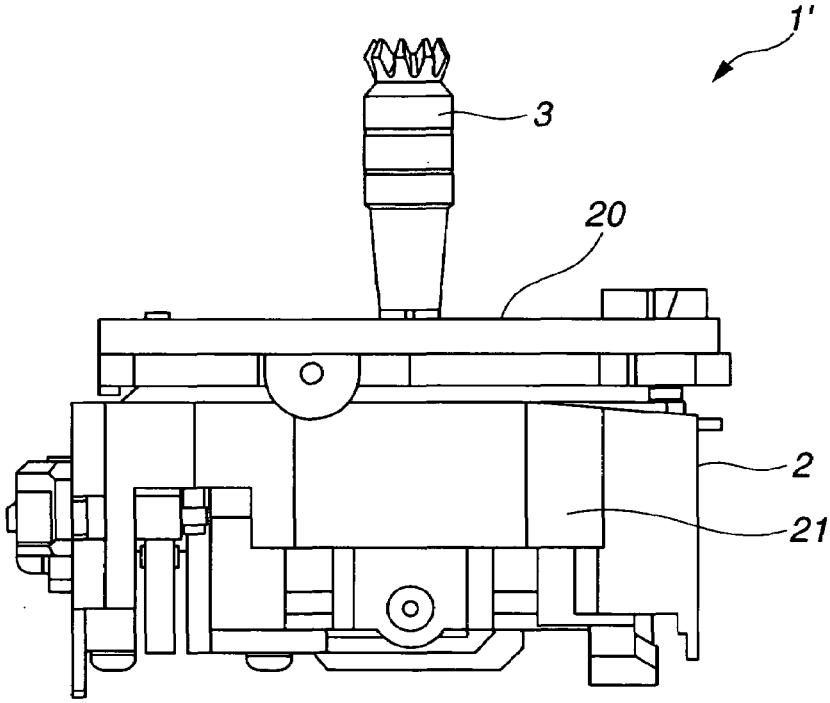
FIG. 3 is a front view illustrating the stick lever unit of the present invention.
Figure 7:
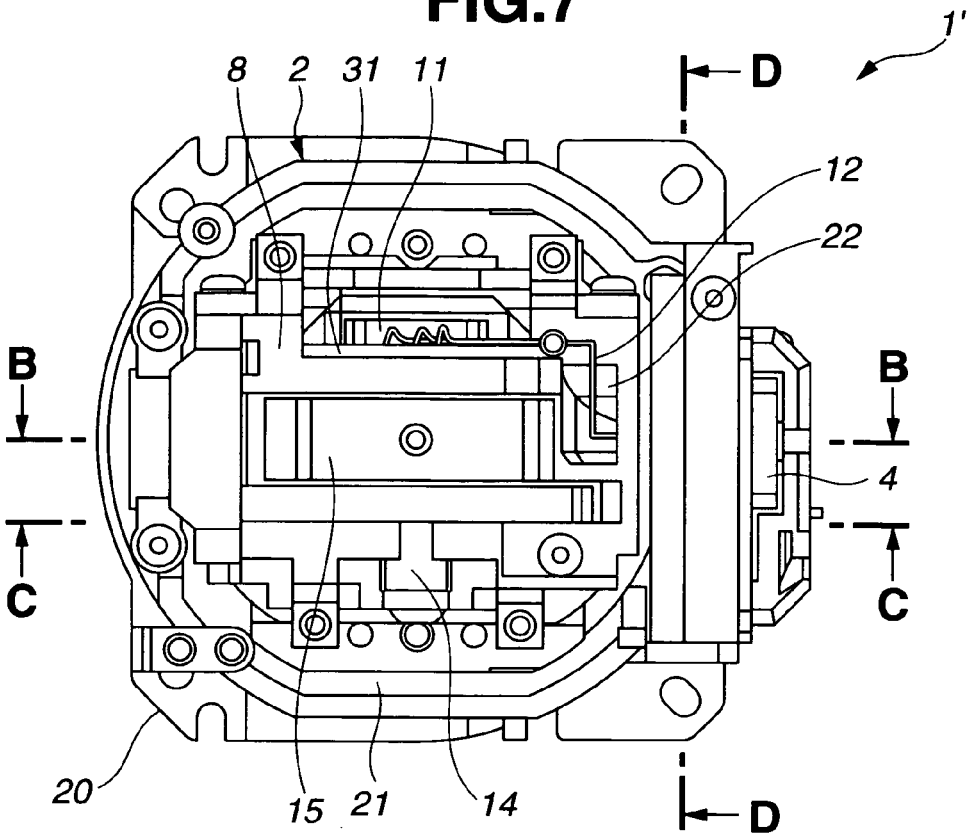
FIG. 7 is a bottom view illustrating the stick lever unit of the present invention.

In the present embodiment, the stick lever unit 1' includes as a main body a fixing member 2 fixed to the housing of the radio-controlled transmitter. As shown in FIG. 2, there is a decorative plate 20, which is fixed to the housing surface of the radio-controlled transmitter on the upper surface of the main body. As shown in FIG. 7, a side wall 21 is disposed below the decorative plate 20 and defines the storing space for the drive mechanism of the stick 3. The storing space is opened downward.

Figure 4:
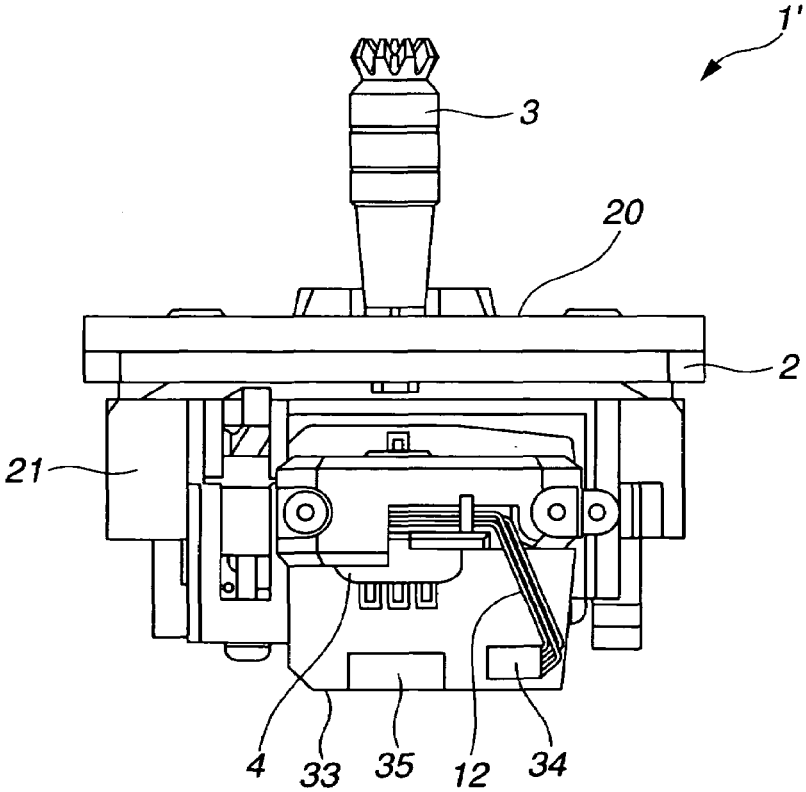
FIG. 4 is a left side view illustrating the stick lever unit of the present invention.
Figure 8:
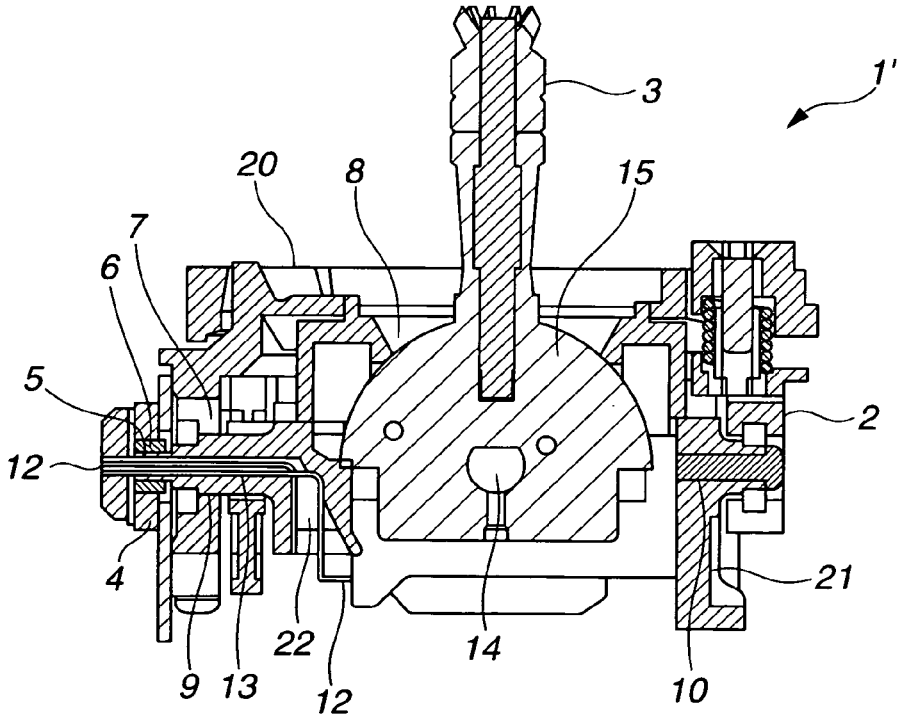
FIG. 8 is a cross-sectional view illustrating the stick lever unit taken along the line A-A of FIG. 2.
Figure 9:
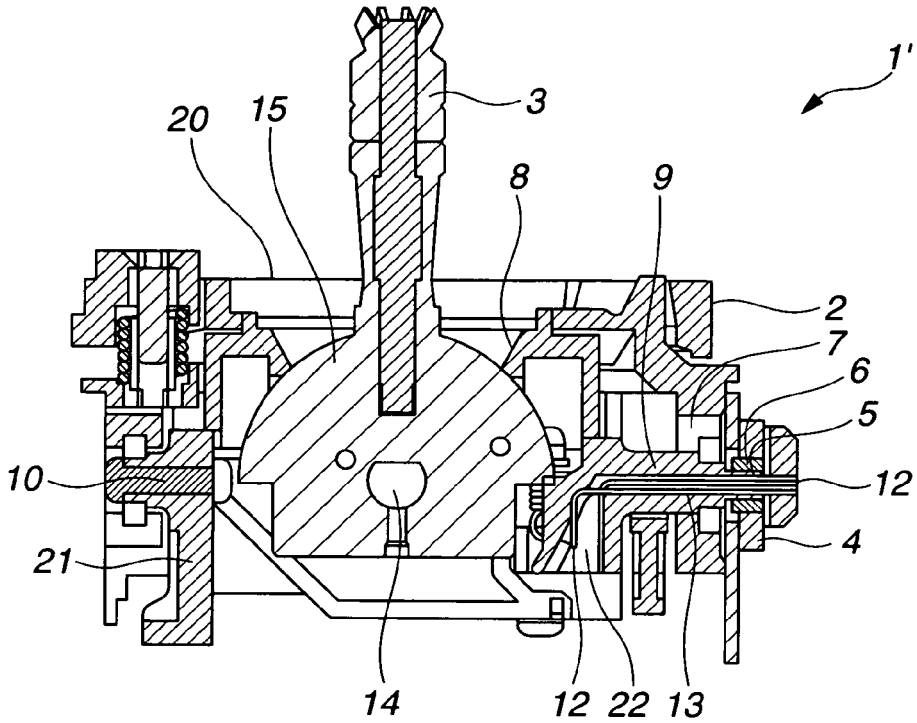
FIG. 9 is a cross-sectional view illustrating the stick lever unit taken along the line B-B of FIG. 7.

As shown in FIGS. 2 and 4, the first variable resistor 4 is formed on the outer surface of a part of the side wall 2 of the fixing member 2. The first variable resistor 4 corresponds to the rotational-type variable resistor, which has been described with reference to FIG. 1. As shown in FIGS. 8 and 9, an opening 7 is formed in one side wall 21 of the fixing member 2. The first variable resistor 4 is attached on the outer side of the fixing member 2 to communicate the through hole 5 with the opening 7.

As shown in FIGS. 7 to 9, a first rotational member 8, which controllably rotates the first variable resistor 4, is disposed in the inner space of the fixing member and journalled rotatably to the fixing member 2. The first rotational member 8 is a nearly rectangular frame member, as a whole, having the space where the rotational mechanism of the stick 3 is assembled therein. A pair of rotational shafts 9 and 10 is protruded on the outer side of a pair of side walls confronting the first rotational member 8, with the axis line aligned. One rotational shaft 10 of the first rotational member 8 is rotationally linked to one side wall 21 of the fixing member 2. The other rotational shaft 9 is inserted into the through hole 5 of the first variable resistor 4 through the opening 7 in the fixing member 2 to link the rotational body 6. Accordingly, when the first rotational member 8 rotates with respect to the fixing member 2, the rotational body 6 of the first rotational resistor 4 rotates, so that the resistance value varies.

In the present embodiment, a pair of rotational shafts 9 and 10 of the first rotational member 8 is integrally shaped to the main body and the axis line is aligned with high accuracy. For that reason, the first rotational member 8 rotates smoothly with respect to the fixing member 2. This provides good feeling during the operation of the stick. Moreover, the first rotational member 8 is first attached rotatably to the fixing member 2. Then, the rotational body 6 of the first variable resistor 4 is inserted into the end of one rotational shaft 9 protruded out from the fixing member 2. The first variable resistor 4 is fixed on the outer surface of the fixing member 2. Since the assembly is performed in such steps, the first variable resistor 4 and the rotational shaft 9 can be assembled without difficulty. During operation of the stick, the first rotational member 8 can be rotated smoothly without applying the burden on the first variable resistor 4. Compared with the conventional stick lever unit where the shaft of the shaft-type variable resistor is used as one rotational shaft of the rotational member, the operational life of the first variable resister 4 can be prolonged.

As show in FIGS. 7 to 9, a lead-out hole 13 for leading the wiring conductors 12 of the second variable resistor 11 (to be described later) is formed in the center of the rotational shaft 9 of the first rotational member 8. One end opens in the end surface of the rotational shaft 9. The other end (on the main body of the first rotational member 8) has the guide hole 22 increasing the diameter toward the upper exit and opens on the upper surface of the main body of the first rotational member 8. That is, the aperture diameter of the guide hole 22 decreases toward the lead-out hole 13.

As shown in FIG. 7, the second variable resistor 11 is attached to one outer surface of a pair of walls of the first rotational member 8, which is parallel to the rotational shafts 9 and 10. The second variable resistor 11 is, as a resistance value varying rotational operation section, a rotational-type variable resistor including the rotational body 6 with the through hole 5. The second variable resistor 11 has the structure identical to the first variable resistor 4. One end of the shaft 14 is journalled rotatably to one of a pair of walls of the first rotational member 8, which is parallel to the rotational shafts 9 and 10. The other end of the shaft 14 is linked to the rotational body 16 of the second variable resistor 11 through the other wall. As shown in FIGS. 7 and 9, a nearly semicircular (or hog-backed) second rotational member 15 is fixed to the shaft 14 in the inner space of the first rotational member 8, with the peripheral surface of the second rotational member 15 facing upward. The stick 3 is attached to the middle of the peripheral surface (the middle of the upper surface) of the second rotational member 15. The stick 3 penetrates the slit of the decorative plate 20 on the upper surface of the fixing member 2 and protrudes upward from the decorative plate 20.

Therefore, when the second rotational member 15 rotates with respect to the first rotational member 8 by means of the stick operation, the shaft 14 rotates, so that the resistance value of the second rotational resistor 11 varies. Moreover, for example, the operator arbitrarily manipulates the stick 3 in two perpendicular directions with his fingers and the first rotational member 8 and the second rotational member 15 rotates, if necessary, in a desired direction, respectively. Thus, the first variable resistor 4 and the second variable resistor 11 can be varied by a necessary resistance amount.

In the present embodiment, likewise the first variable resistor 4, the second variable resistor 11 corresponds to the type which the resistance is changed by rotating the rotational body 6, which has the through hole 5. However, the second variable resistor 11 may be made of a shaft-type variable resistor having a shaft protruding out from the main body as a resistance value varying rotational operation section. In this case, the shaft of the second variable resistor is bridged so as to rotate between the pair of walls of the first rotational member 8, which is parallel to the rotational shafts 9 and 10. The second rotational member 15 is attached to the shaft in the inner space of the first rotational member 8.

In the present embodiment, the stick lever unit 1' has a restoring mechanism that restores the first rotational member 8 and the second rotational member 15 to the neutral position. In other words, the first rotational member 8 and the second rotational member 15, as described above, can be rotated in desired directions, with a desired axis line acting as the center. However, the first variable resistor 4 and the second variable resistor 11 are set to the neutral position to have a desired middle resistance value. When an external force is not applied to the stick 3, the first rotational member 8 and the second rotational member 15 are set to the neutral position by means of the biasing means.

Figure 11:
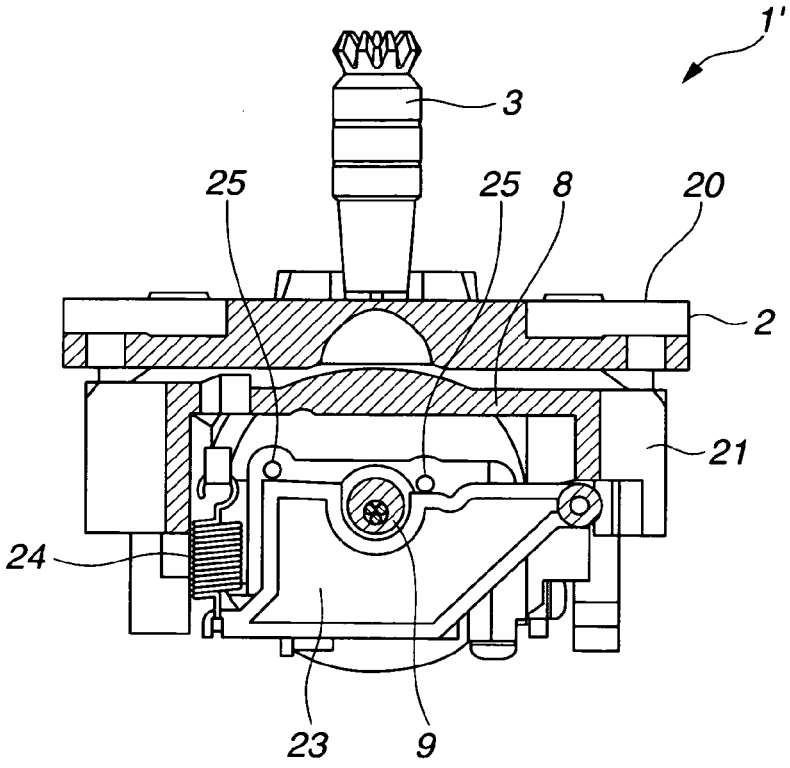
FIG. 11 is a cross-sectional view illustrating the stick lever unit taken along the line D-D of FIG. 2.
Figure 12:
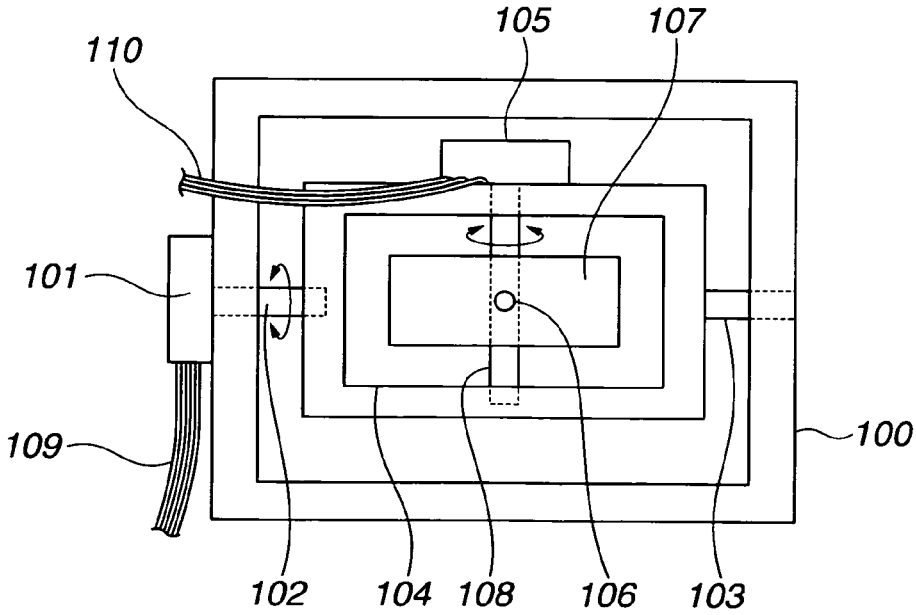
FIG. 12 is a schematic structural view explaining the basic structure of a conventional stick lever unit.

As shown in FIG. 11, a biasing plate 23, acting as a restoring mechanism for restoring the first rotational member 8 to the neutral position, is disposed in the inner space of the fixing member 2 and near to the side wall 21 on which the other rotational shaft 9 of the first rotational member 8 is attached. The biasing plate 23 has a plate surface perpendicular to the rotational shafts 9 and 10 and is a nearly rectangular plate rockable in the plane perpendicular to the rotational shafts 9 and 10. In the biasing plate 23, one end is linked rotatably to the fixing member 2 and the other end is pulled up by the spring 24 acting as biasing member disposed between the fixing members 2. The upper fringe abuts the pin 25 attached on the first rotational member 8 and is set at the first rotational member 8 to the neutral position.

Figure 10:
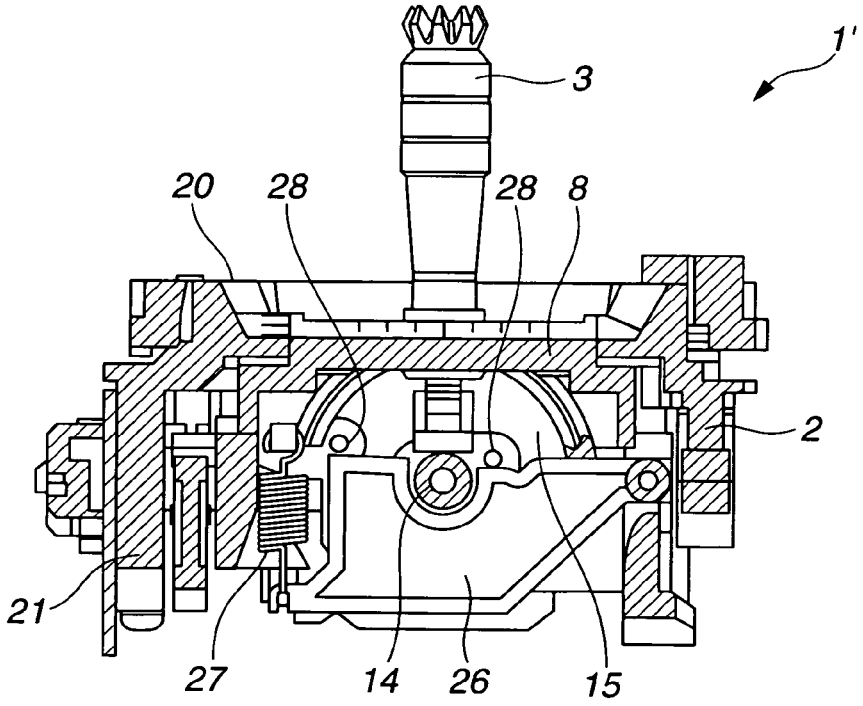
FIG. 10 is a cross-sectional view illustrating the stick lever unit taken along the line C-C of FIG. 7.

As shown in FIG. 10, a biasing plate 26, acting as a restoring mechanism for returning the second rotational member 15 to the neutral position, is disposed in the inner space of the first rotational member 8. The biasing plate 26 has a plate surface perpendicular to the shaft 14 of the second variable resistor 11 and is a nearly rectangular plate rockable in the plane perpendicular to the shaft 14. In the biasing plate 26, one end is linked rotatably to the fixing member 2 and the other end is pulled up by the spring 27 acting as biasing means disposed between fixing members 2. The upper fringe abuts the pin 28 attached to the second rotational member 15 and the second rotational member 15 is set to a neutral position.

Figure 5:
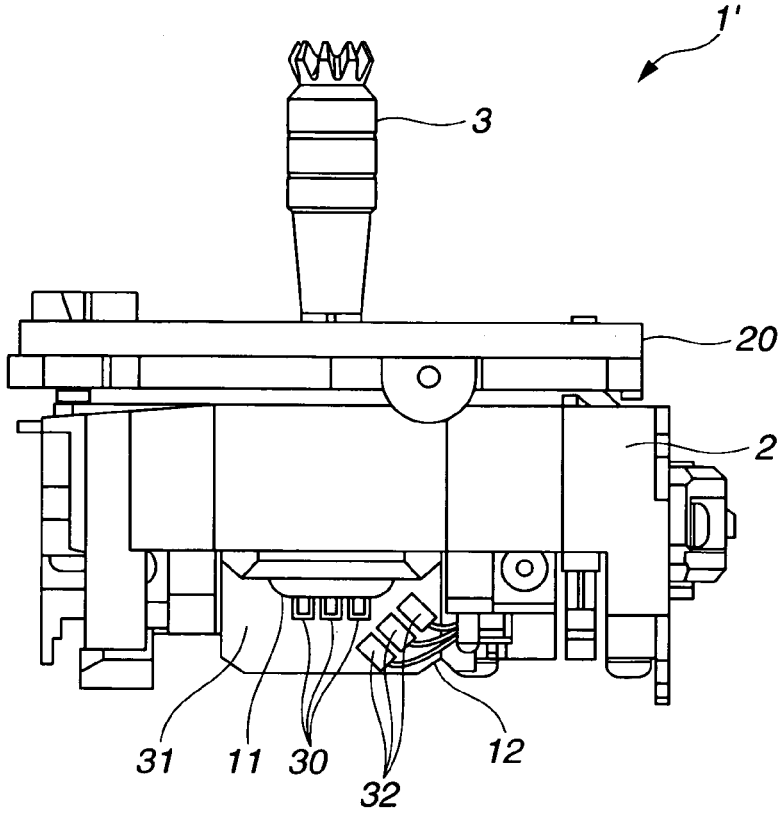
FIG. 5 is a rear view illustrating the stick lever unit of the present invention.
Figure 6:
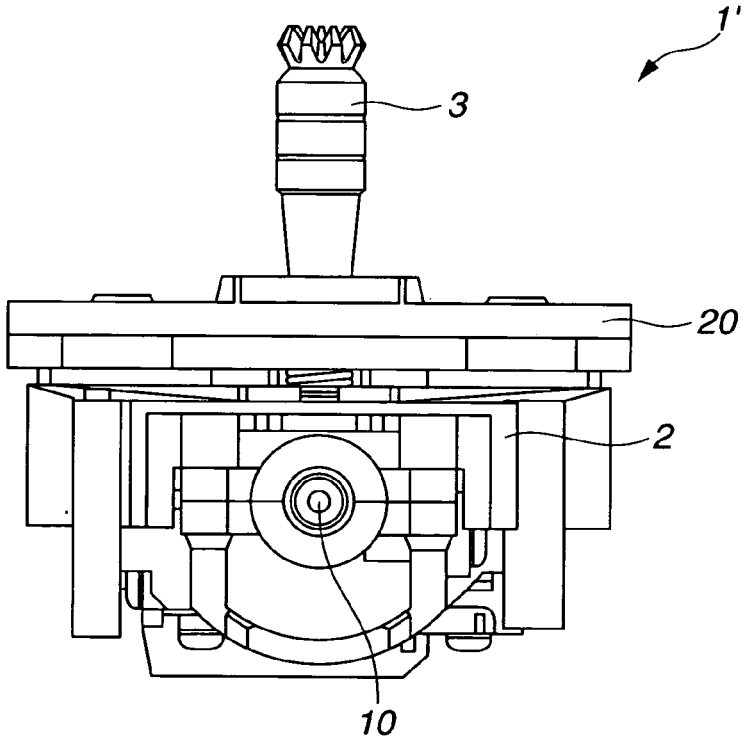
FIG. 6 is a right side view illustrating the stick lever unit of the present invention.

As shown in FIGS. 4, 5, and 7 to 9, the wiring conductors 12 of the second variable resistor 11, which has a special structure, is derived from the fixing member 2. In other words, the three terminals 30 of the second variable resistor 11, as shown in FIG. 5, are connected to three wiring conductors 12 from three connection terminals 32 via the print wiring conductors (not shown) formed on the substrate 31. The wiring conductors 12, as shown in FIG. 7 to 9, are run along the outline of the first rotational member 8, inserted into the lead-out hole 13 of the rotational shaft 9 from the guide hole 22 opening the upper surface of the first rotational member 8, and led out from the fixing member 2 through the opening at the end of the rotational shaft 9. As shown in FIG. 4, the wiring conductors 12 derived out from the fixing member 2 are connected to the terminal 34 of the substrate 33. Three terminals of the first variable resistor 4 are connected to the substrate 33. Six wiring conductors in total of two variable resistors 4 and 11 via the print wiring conductors (not shown) are bundled into conductors of four kinds (including a plus signal line, a minus signal line, and two middle tap signal line) and connected to the corrective terminal 35 of the substrate 33.

The first variable resistor 4 is fixed to the fixing member 2 but the second variable resistor 11 rotates together with the first rotational member 28. Hence, if the conventional structure is employed where the wiring conductors of the second variable resistor 11 are drawn out from the fixing member 2, with no change, to connect to the substrate 33, the wiring conductors 12 move, so that the movement of the wiring conductors 12 affects the operation feeling of the stick 3.

However, according to the present embodiment, the wiring conductors 12 of the second variable resistor 11 are derived out from the fixing member 2 through the lead-out hole 13 in the first rotational member 8 and through the opening of the shaft end of the rotational shaft 9. In such a manner, since the wiring conductors 12 of the second variable resistor 11 are held in the lead-out hole 13 formed along the center of the rotational shaft 9 of the first rotational member 8, the whole of the wiring conductors 12 do not move with the rotation of the first rotating member 8. For that reason, the existence of the wiring conductors 12 does not provide the resistance to the rotation of the first rotational member 8 and does not adversely affect the operation feeling of the stick 3. Moreover, because the wiring conductors 12 of the second variable resistor 11 do not largely move, there is no fear of line breakage due to repetitive operation In the present embodiment, the wiring conductors 12 of the second variable resistor 11 are drawn out from the fixing member 2 through the lead-out hole 13 formed in the rotational shaft 9 of the first rotational member 8. However, the wiring conductors 12 of the second variable resistor 11 may be derived out from the fixing member 2 through the lead-out hole formed in the rotational shaft 10. The path for leading wiring conductors through the fixing member 2 can be arbitrarily selected according to the convenience of electrical connection to external devices and the necessity in device designing.

The invention has been described in connection with what are presently considered to be the most practical and preferred embodiments. However, the present invention has been presented by way of illustration and is not intended to be limited to the disclosed embodiments. Accordingly, those skilled in the art will realize that the invention is intended to encompass all modifications and alternative arrangements included within the spirit and scope of the invention, as set forth by the appended claims.

What is claimed is:

1. A stick lever unit comprising, a fixing member;

a first variable resistor attached to said fixing member;

a first rotational member rotatably journalled to said fixing member, for rotationally controlling said first variable resistor;

a second variable resistor attached to said first rotational member; and a second rotational member having a stick lever, said second rotational member being rotationally journalled to said first rotational member to rotationally control said second variable resistor;

said first rotational member having a first rotational shaft journalled on said fixing member and a second rotational shaft linked to a rotational operation section of said first variable resistor;

at least one of said first and second rotational shafts having a lead-out hole for deriving electrical wiring conductors connected to said second variable resistor externally from said fixing member.

2. A stick lever unit comprising, a fixing member;

a first variable resistor attached to said fixing member;

a first rotational member rotatably journalled to said fixing member, for rotationally controlling said first variable resistor;

a second variable resistor attached to said first rotational member; and a second rotational member having a stick lever, said second rotational member being rotationally journalled to said first rotational member to rotationally control said second variable resistor;

said first rotational member having a rotational shaft which is journalled on a rotational operation section of said first variable resistor;

said rotational shaft having a lead-out hole for deriving electrical wiring conductors connected to said second variable resistor externally from said fixing member.

3. The stick lever unit as defined in claim 1, wherein said first variable resistor comprises a rotational body having a through hole, as a rotational operation section for varying a resistance value; and wherein said rotational shaft of said first rotational member is inserted into said through hole of said first variable resistor and is linked to said rotational body; and wherein said lead-out hole of said rotational shaft is communicated with the inner side and the outer side of said fixing member.

4. The stick lever unit as defined in claim 3, wherein said fixing member has an opening at its side surface; and wherein said first variable resistor is attached to an outer surface of said fixing member in such a way that said through hole communicates with said opening; and wherein said rotational shaft of said first rotational member is inserted into said through hole in said first variable resistor, thus being linked to said rotational body.

5. The stick lever unit as defined in claim 3, wherein said lead-out hole opens at an end of said rotational shaft and opens in the inside of said fixing member through a guide hole continuously formed in a direction perpendicular to said lead-out hole.

6. The stick lever unit as defined in claim 5, wherein said aperture diameter of said guide hole decreases gradually toward said lead-out hole.

7. The stick lever unit as defined in claim 2, wherein said first variable resistor comprises a rotational body having a through hole, as a rotational operation section for varying a resistance value; and wherein said rotational shaft of said first rotational member is inserted into said through hole of said first variable resistor and is linked to said rotational body; and wherein said lead-out hole of said rotational shaft is communicated with the inner side and the outer side of said fixing member.

8. The stick lever unit as defined in claim 7, wherein said fixing member has an opening at its side surface; and wherein said first variable resistor is attached to an outer surface of said fixing member in such a way that said through hole communicates with said opening; and wherein said rotational shaft of said first rotational member is inserted into said through hole in said first variable resistor, thus being linked to said rotational body.

9. The stick lever unit as defined in claim 7, wherein said lead-out hole opens at an end of said rotational shaft and opens in the inside of said fixing member through a guide hole continuously formed in a direction perpendicular to said lead-out hole.

10. The stick lever unit as defined in claim 9, wherein said aperture diameter of said guide hole decreases gradually toward said lead-out hole.

* * * * *